US008622724B2

(12) United States Patent
Calhoun et al.

(10) Patent No.: US 8,622,724 B2
(45) Date of Patent: Jan. 7, 2014

(54) SCROLL PUMP WITH ISOLATION BARRIER

(75) Inventors: John Calhoun, Lexington, MA (US); Romeo Boris Filip, Framingham, MA (US); Ronald Bernard Boudreau, Boxborough, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 1138 days.

(21) Appl. No.: 12/567,625

(22) Filed: Sep. 25, 2009

(65) Prior Publication Data

US 2011/0076172 A1 Mar. 31, 2011

(51) Int. Cl.

| | |
|---|---|
| ***F01C 1/02*** | (2006.01) |
| ***F01C 1/063*** | (2006.01) |
| ***F04C 2/02*** | (2006.01) |
| ***F04C 2/063*** | (2006.01) |
| ***F04C 18/02*** | (2006.01) |
| ***F04C 18/063*** | (2006.01) |

(52) U.S. Cl.

USPC ..... 418/55.3; 418/55.1; 418/55.2; 418/55.5

(58) Field of Classification Search

USPC ..... 418/55.1, 55.2, 55.5, 55.3

See application file for complete search history.

(56) References Cited

U.S. PATENT DOCUMENTS

| | | | | |
|---|---|---|---|---|
| 3,802,809 | A * | 4/1974 | Vulliez | 418/55.2 |
| 4,534,718 | A | 8/1985 | Blain | |
| 4,927,339 | A * | 5/1990 | Riffe et al. | 418/55.5 |
| 5,616,015 | A | 4/1997 | Liepert | |
| 5,951,268 | A | 9/1999 | Pottier et al. | |
| 7,261,528 | B2 | 8/2007 | Liepert et al. | |
| 2005/0063850 | A1 * | 3/2005 | Liepert et al. | 418/55.1 |
| 2006/0051225 | A1 * | 3/2006 | Dovey et al. | 418/55.1 |

* cited by examiner

*Primary Examiner* — Mary A Davis

(57) ABSTRACT

Scroll pumping apparatus includes a first scroll element and a second scroll element; a drive mechanism operatively coupled to the second scroll element for producing orbiting motion of the second scroll element relative to the first scroll element, the drive mechanism having an axis of rotation; and an isolation element to isolate a first volume and a second volume in the scroll pumping apparatus. The isolation element includes a first resilient annular member coupled, directly or indirectly, to the first scroll element, a second resilient annular member coupled, directly or indirectly, to the second scroll element, and a tubular member coupled between the first and second annular members.

18 Claims, 6 Drawing Sheets

SCROLL PUMP WITH ISOLATION BARRIER

FIELD OF THE INVENTION

This invention relates to scroll-type pumps and, more particularly, to devices and methods for isolation of the bearings and other lubricated components of such pumps from a working volume where compression and pumping of the fluid takes place.

BACKGROUND OF THE INVENTION

Scroll-type devices are well known in the field of vacuum pumps and compressors. In a scroll device, a movable spiral blade orbits with respect to a fixed spiral blade within a housing. The movable spiral blade is connected to an eccentric drive mechanism. The configuration of the scroll blades and their relative motion traps one or more volumes or "pockets" of a gas between the blades and moves the gas through the device. Most applications apply rotary power to pump the gas through the device. Other applications include expanders, which operate in reverse from compressors and extract power from the expansion of a pressurized gas.

A scroll pump includes stationary and orbiting scroll elements, and a drive mechanism. The stationary and orbiting scroll elements each include a scroll plate and a spiral scroll blade extending from the scroll plate. The scroll blades are intermeshed together to define interblade pockets. The drive mechanism produces orbiting motion of the orbiting scroll element relative to the stationary scroll element so as to cause the interblade pockets to move toward the pump outlet.

For proper function of the scroll pump, it is necessary to maintain a fixed angular relation, or synchronization, between the two scroll elements. Scroll pumps typically utilize one or more devices for synchronizing the intermeshed scroll blades. Each synchronizing device is coupled, directly or indirectly, between the stationary and orbiting scroll elements and is required to permit orbiting movement while preventing relative rotation of the scroll elements. In one prior art approach, disclosed in U.S. Pat. No. 801,182 issued Oct. 3, 1905, three crank mechanisms are connected between the orbiting and stationary scroll elements.

Oil-lubricated scroll devices are widely used as refrigerant compressors. Oil-lubricated scroll pumps have not been widely adopted for use as vacuum pumps, mainly because the cost of manufacturing a scroll pump is significantly higher than a comparably-sized, oil-lubricated vane pump. In cases where oil contamination is unacceptable, dry scroll pumps are used. Normally these pumps contain multiple rolling element bearings which require lubrication. One approach to lubrication is to use a low-vapor-pressure synthetic grease. However, some degree of contamination can still occur when the bearings are located within the vacuum space of the pump. In addition, the lubricating performance of such greases is generally inferior, and their cost higher, than equivalent petroleum greases.

Accordingly, methods have been devised to isolate the bearings from the pumping mechanism while still permitting the relative orbital motion of the fixed and moving scroll elements. U.S. Pat. No. 5,951,268, issued Sep. 14, 1999, describes the use of a flexible metal bellows for isolation of the running gear of a scroll pump, also relying on the bellows for synchronization of the scroll elements. The torsional load on the bellows due to its function in synchronization poses a risk of failure due to metal fatigue. U.S. Pat. No. 7,261,528, issued Aug. 28, 2007 to assignee of the present invention, describes the use of a rectangular flexible metal element for synchronization as well as to take axial loads, while using a bellows, rotatably mounted, for isolation.

Prior art use of tubular bellows for isolation requires that the bellows be of sufficient length to reduce the stresses in the bellows material below the fatigue life limit for the material. Increased bellows length increases the length of the pump, which may be unacceptable in many applications. Consequently, improved methods of isolating the running gear of a scroll pump from the vacuum space are needed.

SUMMARY OF THE INVENTION

According to a first aspect of the invention, scroll pumping apparatus is provided. The scroll pumping apparatus comprises: a first scroll element and a second scroll element; a drive mechanism operatively coupled to the second scroll element for producing orbiting motion of the second scroll element relative to the first scroll element, the drive mechanism having an axis of rotation; and an isolation element to isolate a first volume and a second volume in the scroll pumping apparatus, the isolation element including a first resilient annular member coupled, directly or indirectly, to the first scroll element, a second resilient annular member coupled, directly or indirectly, to the second scroll element, and a tubular member coupled between the first and second annular members.

Isolation of the bearings and other contamination-generating components from the working volume of the pump is provided by an isolation element including two substantially annular members, joined by a tubular member. In the operation of the scroll pump, the annular members deflect to accommodate the lateral displacement of the orbiting scroll element with respect to the fixed scroll element.

In some embodiments, one or both ends of the isolation element is rotatably mounted to a respective mating component, and synchronization is provided by one or more separate synchronization devices. Thus the isolation element is not subjected to torsional stress.

In some embodiments, one or both of the annular members may be convoluted in a pattern of concentric circular convolutions to provide flexibility.

In some embodiments, the annular members of the isolation element may be joined by a short tubular bellows to provide additional flexibility.

In some embodiments, at least one of the annular members may include an elastomeric disk, of constant or non-constant section, to provide the desired flexibility.

In some embodiments, at least one of the annular members may include a dome-shaped element to provide the desired flexibility.

In some embodiments, both ends of the isolation element may be non-rotatably mounted, one end directly or indirectly coupled to the orbiting scroll element, and the other end directly or indirectly coupled to the pump housing or fixed scroll element, thus providing synchronization between the two scroll elements. In this case, although the isolation element is exposed to torsional stress, the complexity of the pump can be reduced as separate synchronization devices are not required.

According to a second aspect of the invention, a method is provided for operating scroll pumping apparatus of the type comprising a first scroll element and a second scroll element. The method comprises producing orbiting motion of the second scroll element relative to the first scroll element with respect to an axis of rotation; and isolating, using an isolation element, a first volume and a second volume in the scroll pumping apparatus during orbiting motion, the isolation element including a first resilient annular member coupled, directly or indirectly, to the first scroll element, a second resilient annular member coupled, directly or indirectly, to the second scroll element, and a tubular member coupled between the first and second annular members.

According to a third aspect of the invention, scroll pumping apparatus comprises a scroll set having an inlet and an outlet, the scroll set comprising a stationary scroll element including a stationary scroll blade and an orbiting scroll element including an orbiting scroll blade, wherein the stationary and orbiting scroll blades are intermeshed together to define one or more interblade pockets; a drive mechanism operatively coupled to the orbiting scroll element for producing orbiting motion of the orbiting scroll blade relative to the stationary scroll blade so as to cause the one or more interblade pockets to move toward the outlet, the drive mechanism having an axis of rotation; and an isolation element to isolate a first volume and a second volume in the scroll pumping apparatus, the isolation element including a first resilient annular member coupled, directly or indirectly, to the stationary scroll element, a second resilient annular member coupled, directly or indirectly, to the orbiting scroll element, and a tubular member coupled between the first and second annular members.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
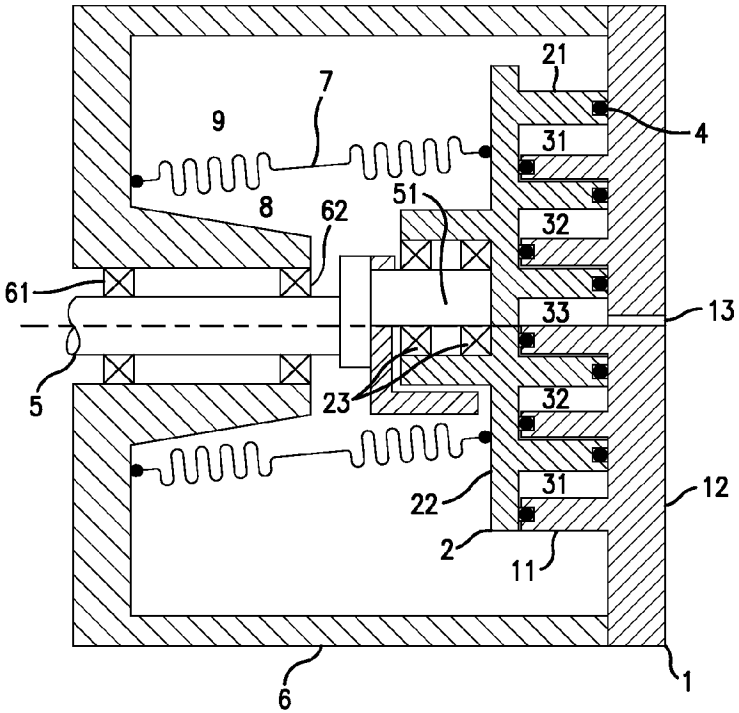
FIG. 1 PRIOR ART
FIG. 1 is a schematic, cross-sectional diagram of a scroll pump in accordance with the prior art.

A scroll pump in accordance with the prior art is shown in FIG. 1. A gas, typically air, is evacuated from a vacuum chamber or other equipment (not shown) connected to an inlet of the pump. A pump body includes a fixed scroll element 1 and a pump housing 6. The pump includes an outlet 13 for exhaust of the gas being pumped.

The scroll pump includes a set of intermeshed, spiral-shaped scroll blades. The fixed scroll element 1 includes a stationary scroll blade 11 extending from a stationary scroll plate 12. An orbiting scroll element 2 includes an orbiting scroll blade 21 extending from an orbiting scroll plate 22. Scroll blades 11 and 21 extend axially toward each other and are intermeshed together to form interblade pockets 31, 32, 33. Tip seals 4, located in grooves at the tips of the scroll blades, provide sealing between the scroll blades. Orbiting motion of scroll blade 21 relative to scroll blade 11 produces a scroll-type pumping action of the gas entering the interblade pockets 31, 32, 33 between the scroll blades.

A drive mechanism for the scroll pump includes a motor (not shown) coupled through a crankshaft 5 to orbiting scroll element 2. An end 51 of crankshaft 5 has an eccentric configuration with respect to the main part of crankshaft 5 and is mounted to orbiting scroll element 2 through an orbiting plate bearing set 23. Crankshaft 5 is mounted to pump housing 6 through main bearings 61, 62. When the motor is energized, crankshaft 5 rotates in main bearings 61, 62. The eccentric configuration of crankshaft end 51 produces orbiting motion of scroll blade 21 relative to scroll blade 11, thereby pumping gas from the inlet to outlet 13.

The scroll pump may include a bellows assembly 7 coupled between a stationary component of the vacuum pump and the orbiting scroll element 2 so as to isolate a first volume 8 inside bellows assembly 7 and a second volume 9 outside bellows assembly 7. In this prior art scroll pump, the bellows assembly 7 has a fixed connection at each end. Thus, any tendency of the orbiting scroll element 2 to rotate about its own center is inhibited by the torsional stiffness of bellows assembly 7. Bellows assembly 7 is sealed to the stationary and moving components by seals (not shown). The bearings required to drive the pump are isolated from second volume 9 by bellows assembly 7. Thus the vacuum space of second volume 9 is not contaminated by grease or oil as long as bellows assembly 7 and its end seals remain intact.

Figure 2:
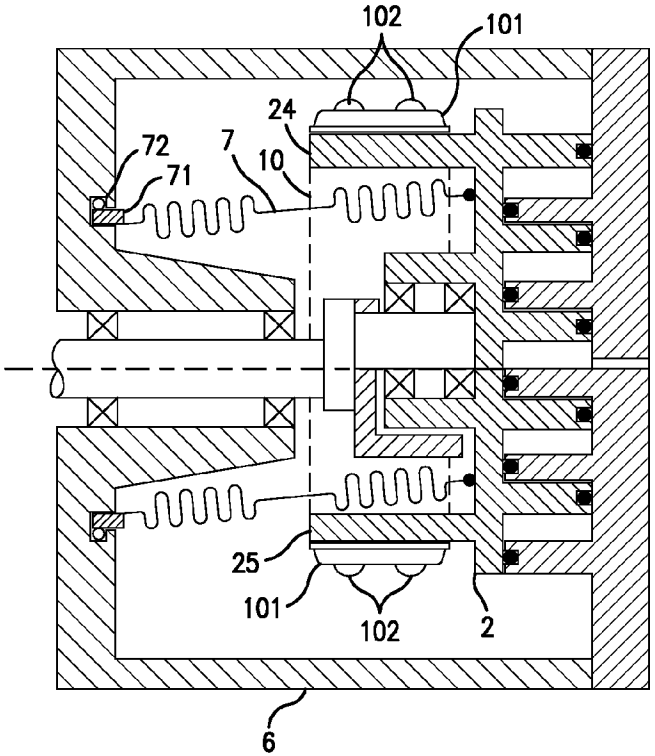
FIG. 2 PRIOR ART
FIG. 2 is a schematic, cross-sectional diagram of another scroll pump in accordance with the prior art.

Another scroll pump in accordance with the prior art is shown in FIG. 2. In this case, bellows assembly 7 is mounted to orbiting scroll element 2 by a non-rotatable connection (not shown in detail). Bellows assembly 7 is mounted to the pump housing 6 by a rotatable connection including ring 71 and seal 72. The bellows assembly being thus rotatably mounted, does not inhibit rotation of the orbiting scroll element about the pump axis.

Two supports 24, 25 are mounted to orbiting scroll element 2. Two more supports (not shown) are mounted to a stationary component of the pump housing 6, located at 90 degrees from the two supports 24, 25 mounted to the orbiting scroll element 2. A substantially rectangular strip 10 is connected to supports 24, 25 by clamping plate 101 and screws 102. Similarly, strip 10 is connected to the other two supports on the pump housing by clamping plates and screws (not shown). As described in U.S. Pat. No. 7,261,528, flexible strip 10 thus resists the tendency of orbiting scroll element 2 to rotate about its own axis.

Figure 3:
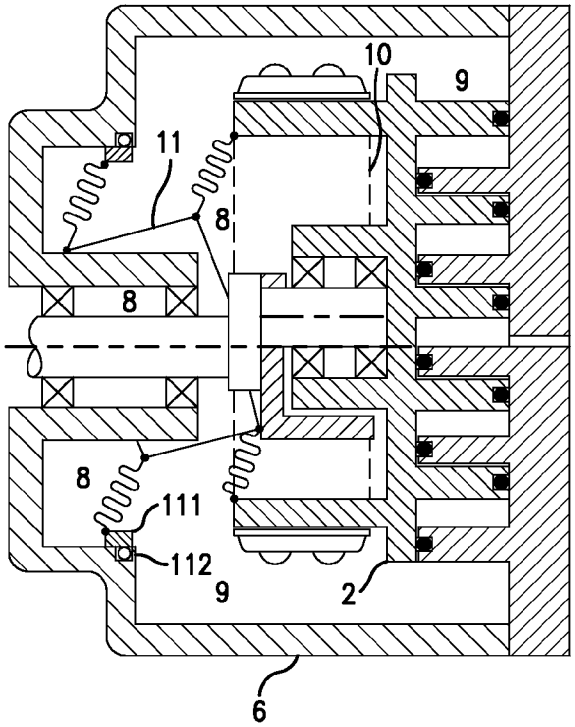
FIG. 3 is a schematic, cross-sectional diagram of a scroll pump in accordance with embodiments of the invention.

FIG. 3 is a schematic cross-sectional diagram of a scroll pump in accordance with embodiments of the invention. Isolation between volumes 8 and 9 is provided by an isolation element 11. Isolation element 11 has a fixed connection to orbiting scroll element 2, and a seal is formed using sealing elements in accordance with standard practice. Isolation element 11 is mounted to pump housing 6 with a rotatable joint including a ring 111 and a seal 112. The design of the fixed and rotatable connections of isolation element 11 to orbiting scroll element 2 and housing 6 is a matter of existing practice and is not relevant to the invention. It will be understood that a variety of seal designs can be employed within the scope of the invention. It will be understood that the rotatable joint may be made from isolation element 11 to orbiting scroll element 2, and the fixed joint to housing 6, within the scope of the invention.

Flexible band 10 is used for synchronization in the same way as in FIG. 2. It will be understood that other synchronization devices may be used within the scope of the invention.

Volume 8 inside the isolation element 11, containing the bearings and rotating components of the pump, is separated from volume 9 outside the isolation element 11, containing the vacuum space and the gas being pumped. The bearings required to drive the pump are isolated from volume 9 by isolation element 11. Thus, contamination of the vacuum space by grease or oil cannot occur as long as isolation element 11 and its end seals remain intact.

Figure 4:
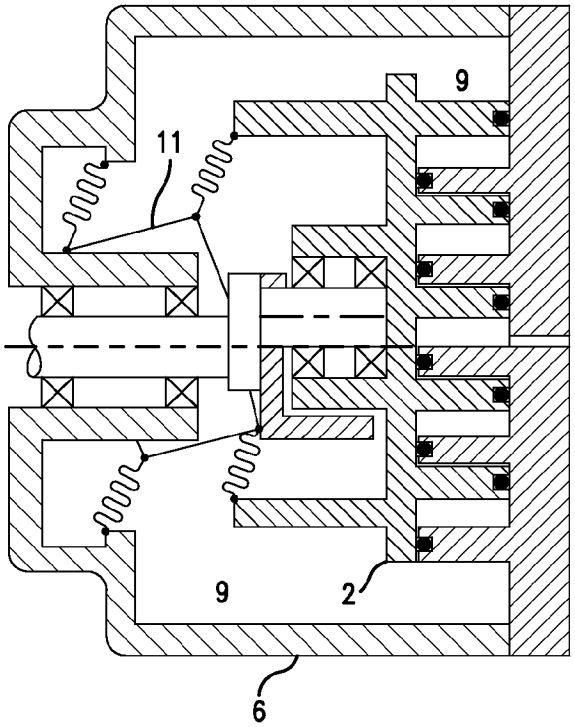
FIG. 4 is a schematic, cross-sectional diagram of another scroll pump in accordance with embodiments of the invention.

FIG. 4 is a schematic cross-sectional diagram of another scroll pump in accordance with embodiments of the invention. In this case, isolation element 11 is mounted in a non-rotatable fashion to both of orbiting scroll element 2 and pump housing 6. Thus, any tendency of the orbiting scroll element 2 to rotate about its center is resisted by the torsional stiffness of isolation element 11. Isolation element 11 is sealed to the stationary and moving components by seals (not shown). The bearings required to drive the pump are isolated from volume 9 by isolation element 11. Thus contamination of the vacuum space by grease or oil cannot occur as long as isolation element 11 and its end seals remain intact. In this embodiment, additional synchronization devices are not required.

Figure 5A:
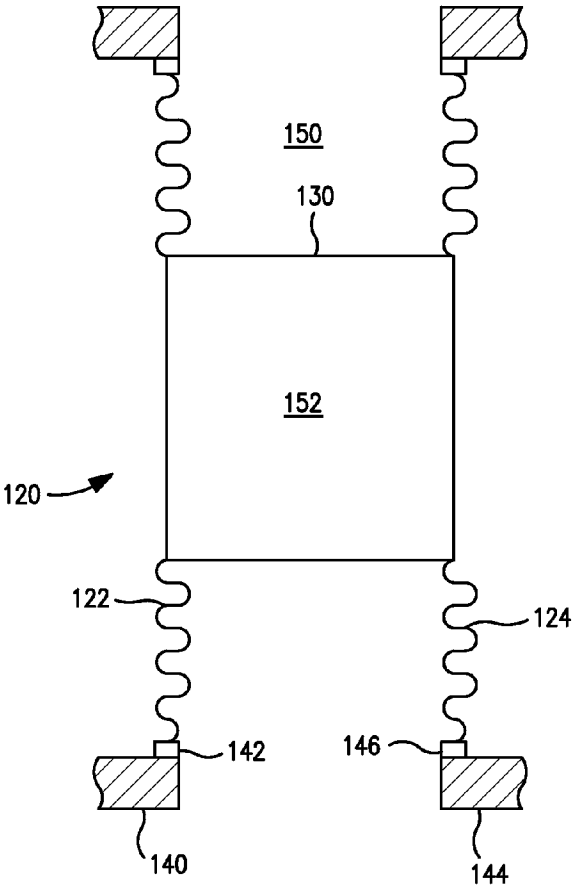
FIG. 5A is a cross-sectional view of the isolation element of FIG. 5, showing connections to a scroll pump.
Figure 5:
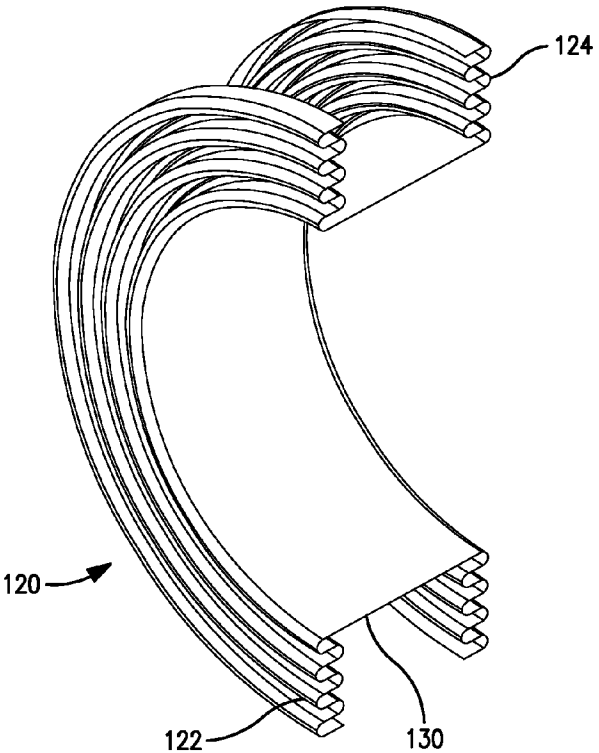
FIG. 5 is a perspective cross-sectional view of an isolation element in accordance with embodiments of the invention.

FIG. 5 is a perspective cross-sectional view of an isolation element 120 in accordance with embodiments of the invention. Convoluted annular members 122 and 124 provide flexibility to accommodate lateral displacement. In applying the isolation element 120 to the scroll pump of FIG. 3, at least one end of the isolation element 120 is rotatably mounted to the housing or the orbiting scroll element. The other end may have a fixed connection to the housing or the orbiting scroll element, or may be rotatably mounted. In the scroll pump of FIG. 4, both ends of the isolation element have a fixed connection, one connection to the housing and one connection to the orbiting scroll element. Sealing and fixing of the ends of the isolation element to the fixed and moving components of the pump are effected by standard sealing and fixing methods. Details of such fixing and sealing methods are known to those skilled in the art.

A cross-sectional diagram of isolation element 120 of FIG. 5 is shown in FIG. 5A. First annular member 122 is sealed at its inside diameter to one end of the tubular member 130, and second annular member 124 is sealed at its inside diameter to an opposite end of tubular member 130. Annular members 122 and 124 are configured to be flexible and resilient to permit lateral and axial deformation, with the annular members returning to their original configurations when the deforming force is removed. In the embodiment of FIGS. 5 and 5A, annular members 122 and 124 have concentric circular convolutions and may be formed, for example, of a thin metal. In the embodiment of FIGS. 5 and 5A, tubular member 130 may be a thin metal tube. Tubular member 130 is shown as having a constant cross section, but may be formed with a non-constant cross section depending on the requirements of the scroll pump in which isolation element 120 is used. In particular, tubular member 130 may have a non-constant diameter along its length and/or may have a non-constant thickness along its length. The parameters of isolation element 120, such as inside diameter, outside diameter, length, material thickness, and the like, depend on the application.

As shown in FIG. 5A, first annular member 122 is coupled to a first pump component 140 through a first seal 142 and second annular member 124 is coupled to a second pump component 144 through a second seal 146. Pump components 140 and 144 undergo orbiting motion relative to each other during pump operation. For example, pump component 140 may be a fixed housing component, and pump component 144 may be an orbiting scroll element. As discussed below, seals 142 and 146 may be fixed seals or rotating seals.

Isolation element 120 is a sealed unit wherein first annular member 122 and second annular member 124 are sealed to tubular member 130. In addition, first annular member 122 is sealed to pump component 140, and second annular member 124 is sealed to pump component 144. Accordingly, isolation element 120 provides isolation between a first volume 150 and a second volume 152, while permitting relative movement of pump components 140 and 144.

Figure 6:
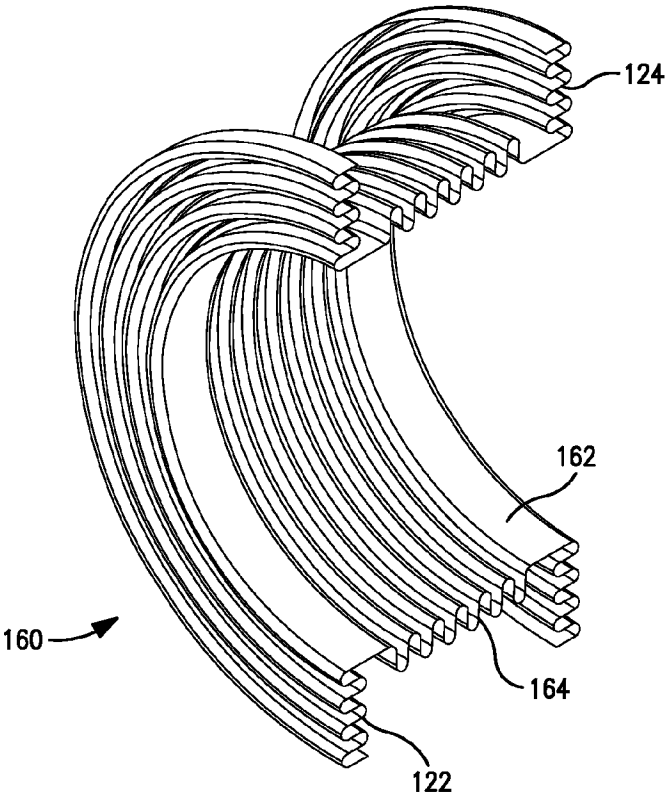
FIG. 6 is a perspective cross-sectional view of another isolation element in accordance with embodiments of the invention.

FIG. 6 is a perspective cross-sectional view of an isolation element 160 in accordance with embodiments of the invention. A tubular member 162 of isolation element 160 includes a bellows section 164 between annular members 122 and 124 to provide additional flexibility in lateral displacement. It will be understood that it may be desired to eliminate one of the annular members. It will be further understood that the flexible tubular bellows section 164 may be located near either end, or in the middle, of the tubular member 162 of the isolation element. More than one tubular bellows section may be included in the tubular member 162 of the isolation element 160, depending on the requirements of the application. One or more tubular bellows sections may be utilized in the tubular member of any of the embodiments described herein.

Figure 7:
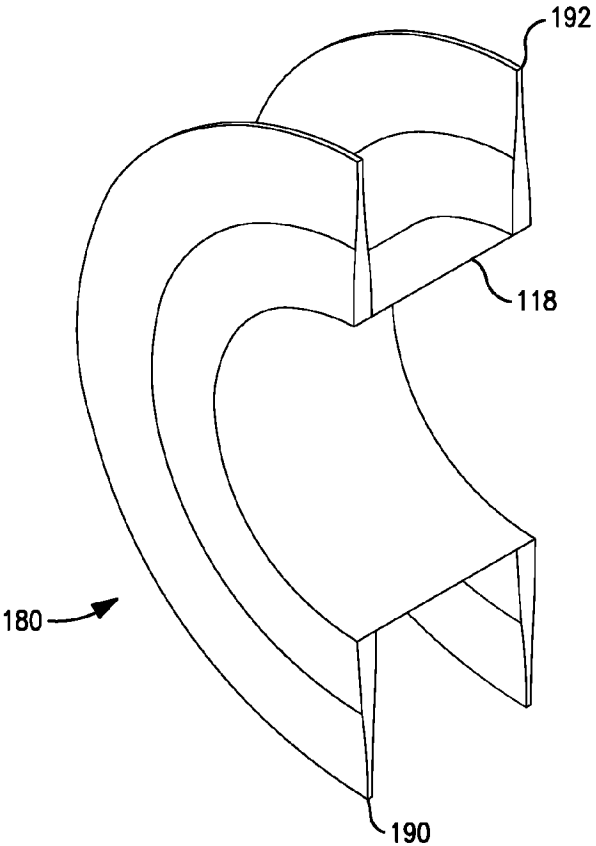
FIG. 7 is a perspective cross-sectional view of another isolation element in accordance with embodiments of the invention.

FIG. 7 is a perspective cross-sectional view of an isolation element 180 in accordance with embodiments of the invention. Elastomeric disks 190 and 192 replace the annular members of FIGS. 5 and 6 to provide flexibility in lateral displacement. Center tube 118 may be of metal, a rigid plastic, or an elastomeric material. It will be understood that the elastomeric disks may replace one or both of the convoluted annular members in other embodiments of the invention.

Figure 8:
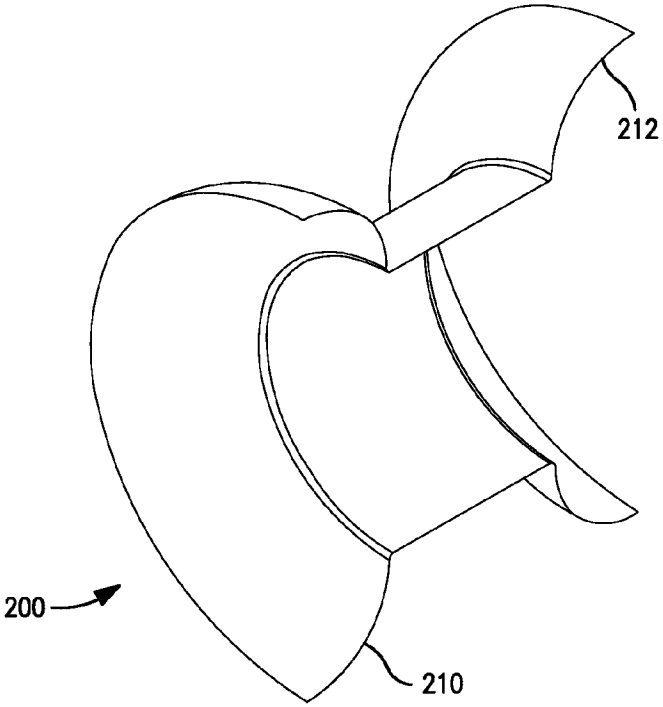
FIG. 8 is a perspective cross-sectional view of another isolation element in accordance with embodiments of the invention.

FIG. 8 is a perspective cross-sectional view of an isolation element 200 in accordance with embodiments of the invention. Dome-shaped members 210 and 212 replace the annular members of FIGS. 5 and 6 to provide flexibility in lateral displacement.

Figure 9:
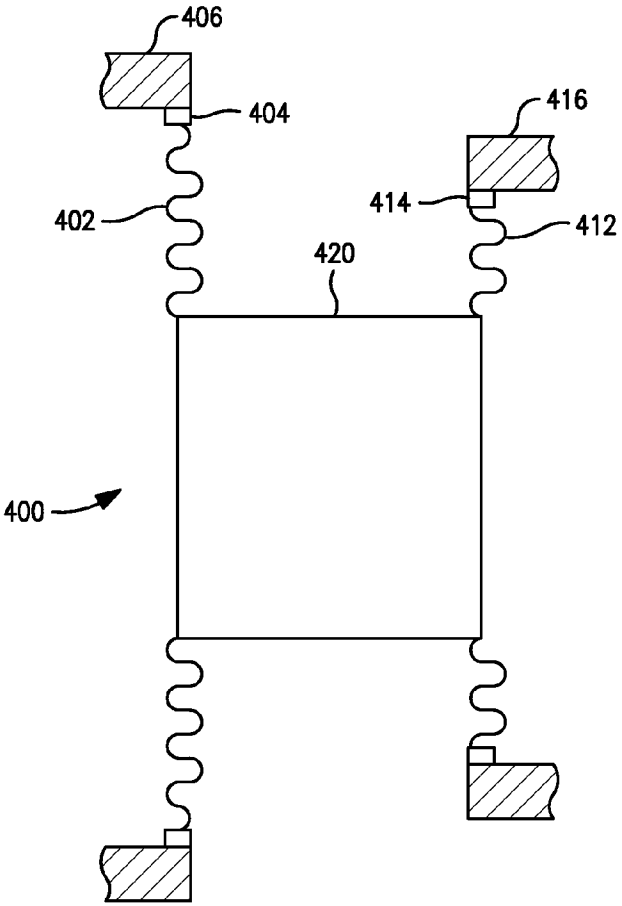
FIG. 9 is a cross-sectional view of an isolation element having annular members of unequal diameter, in accordance with embodiments of the invention.

FIG. 9 is a cross-sectional view of an isolation element 400 in accordance with embodiments of the invention. Isolation element 400 includes a first annular member 402 coupled through a seal 404 to a pump component 406 and a second annular member 412 coupled through a seal 414 to a pump component 416. Annular members 402 and 412 are coupled to opposite ends of a tubular member 420. In the embodiment of FIG. 9, the first annular member 402 and the second annular member 412 have different outside diameters, with the respective diameters being selected according to the geometry of the scroll pump in which it is used. It will be understood that first annular member 402 can have a smaller outside diameter than second annular member 412.

Figure 10:
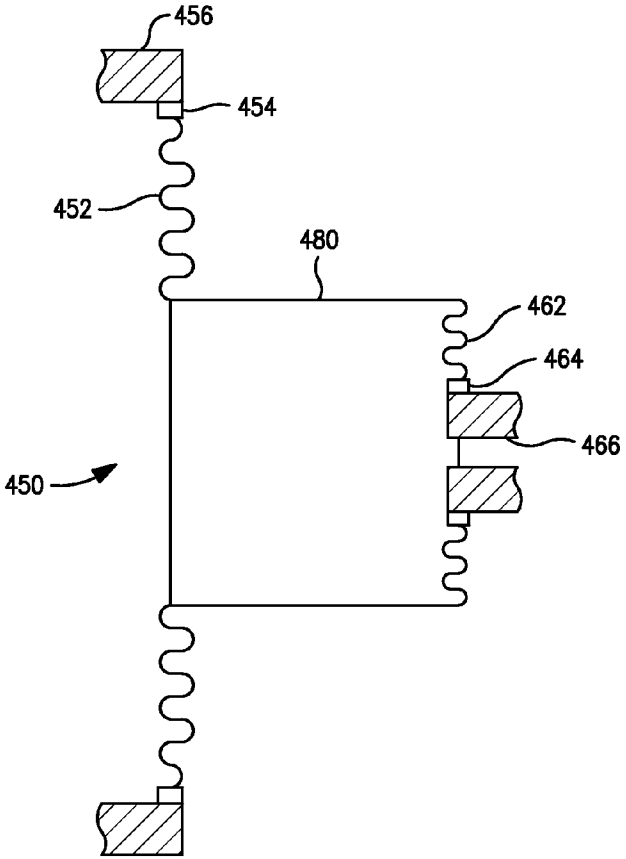
FIG. 10 is a cross-sectional diagram of an isolation element having one annular element extending inwardly from the tubular member, in accordance with embodiments of the invention.

FIG. 10 is a cross-sectional diagram of an isolation element 450 in accordance with embodiments of the invention. Isolation element 450 includes a first annular member 452 sealed to one end of a tubular member 480 and a second annular member 462 sealed to an opposite end of tubular member 480. In the embodiment of FIG. 10, first annular member 452 extends outwardly from tubular member 480, and second annular member 462 extends inwardly from tubular member 480. Tubular member 480 is sealed to the inside diameter of first annular member 452 and is sealed to the outside diameter of second annular member 462. First annular member 452 is coupled through a seal 454 to a pump component 456, and second annular member 462 is coupled through a seal 464 to a pump component 466. The geometry of isolation element 450 is selected to according to the geometry of the scroll pump in which it is used.

Figure 11:
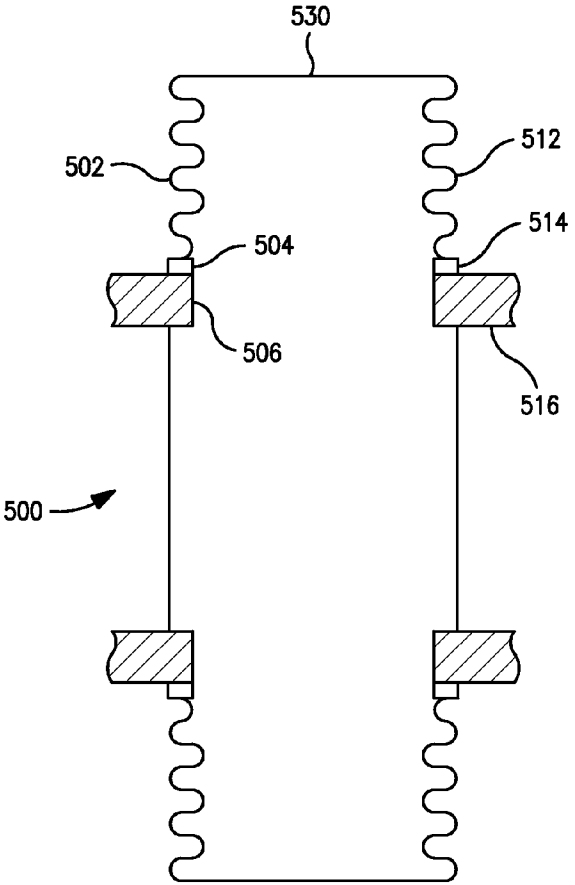
FIG. 11 is a cross-sectional diagram of an isolation element having both annular members extending inwardly from the tubular member, in accordance with embodiments of the invention.

FIG. 11 is a cross-sectional diagram of an isolation element 500 in accordance with embodiments of the invention. In the isolation element 500, a first annular member is sealed to one end of a tubular member 530 and a second annular member 512 is sealed to an opposite end of tubular member 530. In the embodiment of FIG. 11, tubular member 530 is sealed to the outside diameters of annular members 502 and 512, and the annular members 502 and 512 extend inwardly from tubular member 530. An inside diameter of first annular member 502 is coupled through a seal 504 to a pump component 506, and an inside diameter of second annular member 512 is coupled through a seal 514 to a pump component 516. As in previous cases, the geometry of isolation element 500 is selected according to the geometry of a scroll pump in which it is used.

Each of the disclosed isolation elements provides isolation between volumes within a scroll pump. The isolation element permits the lubricated and particle-generating components of the scroll pump, such as bearings and other rotating components, to be isolated from the working volume of the pump. The isolation element provides lateral and axial flexibility to accommodate the orbiting movement of the scroll pump, while providing isolation. It will be understood that the various configurations of the isolation element shown in FIGS. 9-11 and described above can be applied to the isolation elements shown in FIGS. 5-8.

The first scroll element 1 and the second scroll element 2 can be any scroll elements known in the art or later developed. In general, second scroll element 2 describes orbiting motion relative to first scroll element 1 during operation of the scroll pump. The scroll elements 1 and 2 may be single-stage scroll elements or may have two or more stages. An example of a single-stage scroll pump is shown in FIGS. 3 and 4. A scroll pump having more than one stage is disclosed in U.S. Pat. No. 5,616,015, issued Apr. 1, 1997 to assignee of present invention. Each stage of the scroll pump may include one or more scroll blades. In some embodiments, the scroll elements 1 and 2 may include a stationary scroll element and an orbiting scroll element. In other embodiments, the scroll elements 1 and 2 may have a co-rotating configuration, as disclosed in U.S. Pat. No. 4,534,718, issued Aug. 13, 1985, wherein both scroll elements rotate and one scroll element describes orbiting motion relative to the other scroll element. The scroll pump may be oil-lubricated or dry (oil-free) and may operate as a vacuum pump or as a compressor.

In practical applications of the invention, other combinations of the essential features may be used than those illustrated.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A scroll pumping apparatus, comprising:

a first scroll element and a second scroll element;

a drive mechanism operatively coupled to the second scroll element for producing orbiting motion of the second scroll element relative to the first scroll element, the drive mechanism having an axis of rotation; and an isolation element to isolate a first volume and a second volume in the scroll pumping apparatus, the isolation element including a first resilient annular member coupled, directly or indirectly, to the first scroll element, a second resilient annular member coupled, directly or indirectly, to the second scroll element, and a tubular member coupled between the first and second resilient annular members, wherein each of the first and second resilient annular members extend outwardly in at least a partially lateral direction from the outer circumference of the tubular member.

2. A scroll pumping apparatus as defined in claim 1, wherein at least one of the first and second resilient annular members is free to rotate relative to at least one of the first and second scroll elements to which it is coupled.

3. A scroll pumping apparatus as defined in claim 1, wherein the first and second resilient annular members have fixed connections to the respective one of the first and second scroll elements.

4. A scroll pumping apparatus as defined in claim 1, wherein the first and second resilient annular members include concentric circular convolutions that provide axial and lateral flexibility.

5. A scroll pumping apparatus as defined in claim 1, wherein the tubular member includes convolutions.

6. A scroll pumping apparatus as defined in claim 1, wherein the first and second resilient annular members comprise elastomer members.

7. A scroll pumping apparatus as defined in claim 1, wherein the first and second resilient annular members comprise annular disks.

8. A scroll pumping apparatus as defined in claim 1, wherein the first and second resilient annular members are dome-shaped.

9. A method for operating scroll pumping apparatus comprising a first scroll element and a second scroll element, the method comprising:

producing orbiting motion of the second scroll element relative to the first scroll element with respect to an axis of rotation; and isolating, using an isolation element, a first volume and a second volume in the scroll pumping apparatus during orbiting motion, the isolation element including a first resilient annular member coupled, directly or indirectly, to the first scroll element, a second resilient annular member coupled, directly or indirectly, to the second scroll element, and a tubular member coupled between the first and second resilient annular members, wherein each of the first and second resilient annular members extend outwardly in at least a partially lateral direction from the outer circumference of the tubular member.

10. The method as defined in claim 9, further comprising coupling at least one of the first and second annular members to one of the first and second scroll elements so that the at least one of the first and second annular members is free to rotate relative to the scroll element.

11. The method as defined in claim 9, further comprising coupling the first and second resilient annular members to the respective first and second scroll elements using fixed connections.

12. A scroll pumping apparatus, comprising:

a scroll set having an inlet and an outlet, the scroll set comprising a stationary scroll element including a stationary scroll blade and an orbiting scroll element including an orbiting scroll blade, wherein the stationary and orbiting scroll blades are intermeshed together to define one or more interblade pockets;

a drive mechanism operatively coupled to the orbiting scroll element for producing orbiting motion of the orbiting scroll blade relative to the stationary scroll blade so as to cause the one or more interblade pockets to move toward the outlet, the drive mechanism having an axis of rotation; and an isolation element to isolate a first volume and a second volume in the scroll pumping apparatus, the isolation element including a first resilient annular member coupled, directly or indirectly, to the stationary scroll element, a second resilient annular member coupled, directly or indirectly, to the orbiting scroll element, and a tubular member coupled between the first and second resilient annular members, wherein each of the first and second resilient annular members extend outwardly in at least a partially lateral direction from the outer circumference of the tubular member.

13. A scroll pumping apparatus as defined in claim 12, further comprising a synchronization mechanism coupled between the stationary scroll element and the orbiting scroll element.

14. A scroll pumping apparatus as defined in claim 13, wherein at least one of the first and second resilient annular members is free to rotate relative to at least one of the stationary and orbiting scroll elements to which it is sealed.

15. A scroll pumping apparatus as defined in claim 12, wherein the first and second resilient annular members include concentric circular convolutions that provide axial and lateral flexibility.

16. A scroll pumping apparatus as defined in claim 12, wherein the tubular member includes convolutions.

17. A scroll pumping apparatus as defined in claim 12, wherein the first and second resilient annular members comprise elastomer members.

18. A scroll pumping apparatus as defined in claim 12, wherein the first and second resilient annular members are domed shaped.

* * * * *